US005186790A

United States Patent [19]

Powers

[11] Patent Number: 5,186,790

[45] Date of Patent: Feb. 16, 1993

[54] CHEMICAL MILLING OF ALUMINUM-LITHIUM ALLOYS

[75] Inventor: John H. Powers, Lower Burrell, Pa.

[73] Assignee: Aluminum Company of America, Pittsburgh, Pa.

[21] Appl. No.: 611,780

[22] Filed: Nov. 13, 1990

[51] Int. Cl.[5] ..... H01L 21/00

[52] U.S. Cl. ..... 156/665; 156/664; 252/79.1; 252/79.5

[58] Field of Search ..... 252/79.1, 79.5; 156/665, 664

[56] References Cited

U.S. PATENT DOCUMENTS

| | | | |
|---|---|---|---|
| 2,869,267 | 2/1957 | Holman | 252/79.5 |
| 2,890,944 | 6/1959 | Hays | 41/42 |
| 3,356,550 | 12/1967 | Stiffler et al. | 252/79.5 |
| 3,481,877 | 12/1969 | Moll | 156/665 |
| 3,557,000 | 1/1971 | Smith | 252/79.5 |
| 3,810,797 | 5/1974 | Schaffstall et al. | 252/79.5 |
| 3,957,553 | 5/1976 | Smith | 156/22 |
| 4,372,805 | 2/1983 | Takahashi et al. | 156/642 |
| 4,417,949 | 11/1983 | Lindner et al. | 156/665 |
| 4,601,780 | 7/1986 | Coggins et al. | 156/642 |
| 4,826,605 | 5/1989 | Doble et al. | 210/721 |
| 4,851,077 | 7/1989 | Bruce | 156/626 |
| 4,915,782 | 4/1990 | Coggins et al. | 156/665 |

FOREIGN PATENT DOCUMENTS

| | | |
|---|---|---|
| 143715 | 11/1984 | European Pat. Off. . |
| 462899 | 10/1984 | U.S.S.R. . |
| 511386 | 11/1984 | U.S.S.R. . |
| 1188222 | 3/1986 | U.S.S.R. . |
| 1562586 | 9/1982 | United Kingdom . |

*Primary Examiner*—Brian E. Hearn
*Assistant Examiner*—George Goudreau
*Attorney, Agent, or Firm*—Andrew Alexander; Glenn E. Klepac

[57] ABSTRACT

Disclosed is a method of etching a lithium-containing aluminum base alloy product, the method comprising the steps of providing an etch bath comprised of 30–110 gms/liter sodium hydroxide, 15–150 gms/liter aluminum, at least 20 gms/liter sodium sulphide, and at least 20 gms/liter triethanolamine, the remainder water. The bath is maintained at a temperature range of 150° to 225° F. and the product to be etched is immersed therein and then rinsed. This treatment provides a finish having smoothness of less than 100 microinches.

19 Claims, 3 Drawing Sheets

CHEMICAL MILLING OF ALUMINUM-LITHIUM ALLOYS

BACKGROUND OF THE INVENTION

This invention relates to chemical milling or etching solution, and more particularly, it refers to chemical milling solutions for aluminum-lithium alloy products.

In the construction of aircraft, there is always the desire to make components lighter. Thus, the aircraft industry has started using sheet, plate, extrusion or forging components, for example, made from aluminum-lithium alloys. To further lighten the components, they can be selectively chemically milled. However, it has been found that conventional chemical milling baths produce roughened surfaces on the aluminum-lithium alloy parts and the problems attendent therewith. Thus, there is a great need for a chemical milling bath which can be used for selectively etching or milling aluminum-lithium alloy components which does not result in a roughened surface.

In accordance with these requirements, the present invention provides a bath suitable for etching or chemical milling of aluminum-lithium alloys which results in a remarkably smooth surface.

SUMMARY OF THE INVENTION

An object of this invention is to provide a bath composition for chemical milling of aluminum-lithium alloys.

It is a further object of this invention to provide a method for chemical milling of aluminum-lithium alloys which results in a smooth finish.

These and other objects of the invention will be apparent from a reading of the following description and accompanying figures.

In accordance with these objects, there is disclosed a method of etching a lithium-containing aluminum base alloy product, the method comprising the steps of providing an etch bath comprised of 30–110 gms/liter sodium hydroxide, 15–150 gms/liter dissolved aluminum, at least 20 gms/liter sodium sulphide, and at least 20 gms/liter alkanolamine, the remainder water. The alkanolamine is preferably triethanolamine. Some other suitable alkanolamines are diethanolamine and ethyldiisopropanolamine. The bath is maintained at a temperature range of 150° to 225° F. and the product to be etched is immersed therein, rinsed then desmutted. This treatment provides a finish having smoothness of less than 100 microinches.

DETAILED DESCRIPTION OF THE PREFERRED EMBODIMENTS

Figure 1:
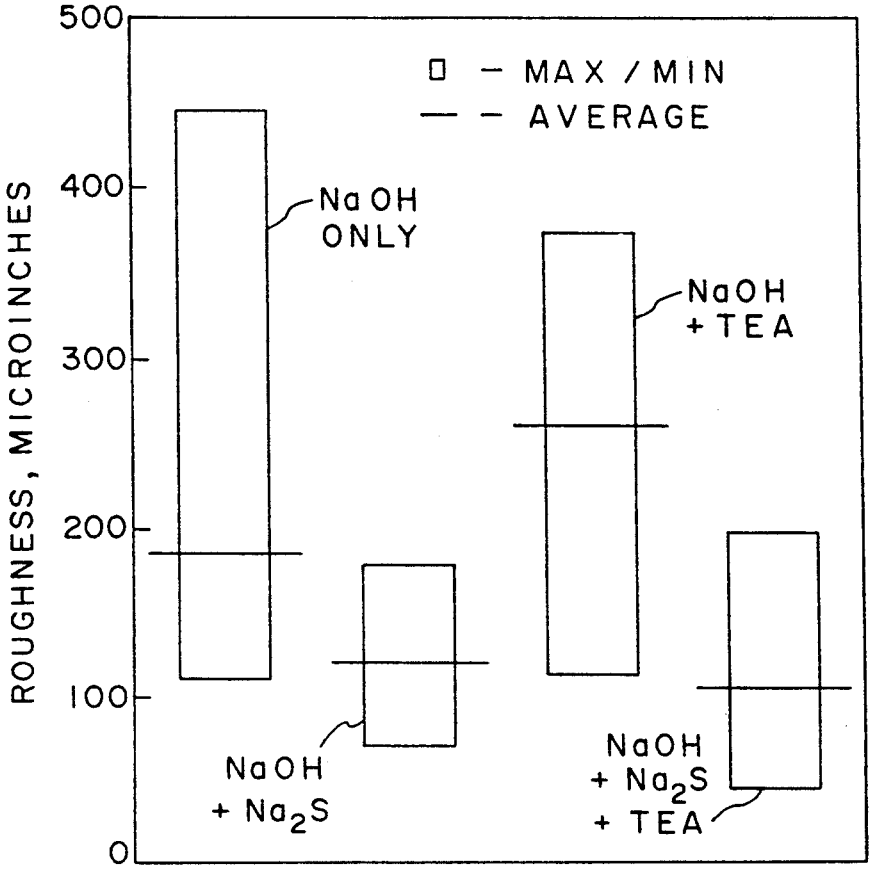
FIG. 1 shows the effect of $Na_2S$ and TEA additions to NaOH on AA2090.

In accordance with the invention, the chemical milling bath can contain 30 to 110 gms/liter NaOH, 5 to 60 grams/liter $Na_2S$ and 30 to 110 gms/liter triethanolamine (TEA) and 10 to 150 gms/liter aluminum, based on a liter of bath comprised of said compounds in water. That is, these compounds are added in these ranges to water to make a total of 1 liter of water and compounds or elements. Preferably, the bath is comprised of 40 to 90 gms/liter NaOH, 20 to 60 gms/liter $Na_2S$, 20 to 60 gms/liter TEA and 20 to 130 gms/liter aluminum based on a liter of bath comprised of these compounds and water. A typical bath would contain about 70 gms/liter NaOH, 35 gms/liter $Na_2S$, 35 gms/liter TEA and not less than 20 gms/liter aluminum based on a liter of bath. That is, in making up a liter of bath, for example, the chemicals are added first and then sufficient water is added to make a total of 1 liter. When the aluminum content is low, it is preferred to use about 60 to 70 gms/liter NaOH, and with higher concentration of aluminum, it is preferred to use broader ranges of NaOH.

For milling or etching aluminum alloys, preferably aluminum alloys containing lithium, such as 2090, 2091, 8090, 8091, 8190, C155, 2020, Weldalite, 1420, 1421, 01430, 01440 and 01450, the bath can be maintained in a temperature range of about 120° to 250° F. By lithium-containing aluminum base alloy is meant any aluminum alloy containing at least 0.25 wt. % lithium and preferably 0.5 wt. % lithium or more. For such alloys, preferably, the bath is maintained in the temperature range of about 160° to 225° F. with a typical temperature being about 215° to 225° F. Following these concentrations and temperature ranges aids in achieving a smooth finish on the aluminum lithium alloy product in accordance with the present invention. Thus, prior to milling, the aluminum- lithium alloy part is first masked, if selective milling is desired, then it is immersed in the bath for sufficient time to remove the desired amount of metal. Thereafter, the part is removed and rinsed in water to remove residual etchant. It may then be immersed in an acid to remove etching smut followed by another rinse to remove residual acid. For purposes of maintaining the bath, $Na_2S$ and TEA should be added with the NaOH in the following proportion: 1:0.5:0.5, NaOH, $Na_2S$ and TEA, respectively.

The bath of the invention has a milling rate of 0.5 to 3 mils/minute-side.

Aluminum alloy parts, particularly aluminum-lithium alloy parts etched or milled in the subject bath, are characterized by having a very smooth surface. Aluminum-lithium alloy parts treated in the bath can have a roughness or roughness height rating (RHR) of 100 microinches or less, e.g., 60 or less microinches. RHR is an arithmetic average in microinches of the surface deviations from absolute smoothness. Standards in the aerospace industry indicate that the surface roughness height rating be either less than 125 microinches or less than 62 microinches, depending upon the use of the part. Thus, it can be seen that the present invention provides a rating which meets the most stringent requirements of the aerospace industry.

The following example is still further illustrative of the invention.

EXAMPLE

Sheets of each alloy and temper (Table 1) included in each experiment were cut into 2.5×2.5 cm (1×1 inch) specimens, deoxidized for 5 minutes at 71.1° C. (160° F.) in a 165 g/L $H_2SO_4$ plus 35 g/L $CrO_3$ solution and weighed. The gauge was measured using the average of ten determinations with the highest and lowest values discarded. Chemical milling was conducted in 4 liters of solution containing NaOH alone and in various combinations with $Na_2S$ and TEA (see Tables 2–7). After chemical milling, each specimen was desmutted in a $CrO_3/H_2SO_4$ solution, reweighed and the final gauge was determined using the same method as prior to etching. Etch rate was calculated as mil/minute-side. Weight loss was used to keep track of the aluminum dissolved in the solution. Surface roughness measurements were made with a Surtronic 3 (Taylor Hobson) instrument using a 250 μm (0.01 inch) cutoff and the average of 8 of the ten determinations. In some cases, a mask was applied in order to obtain fillets for measurement and examination with the microscope.

The first experiment was to determine the effect of $Na_2S$ and TEA additions individually and together on chemical milling response. Concentration of NaOH, temperature and aluminum content were also varied. Surface roughness and etch rate data for 2090-T3 are in Table 2 and for 7075-T6 in Table 3.

Figure 2:
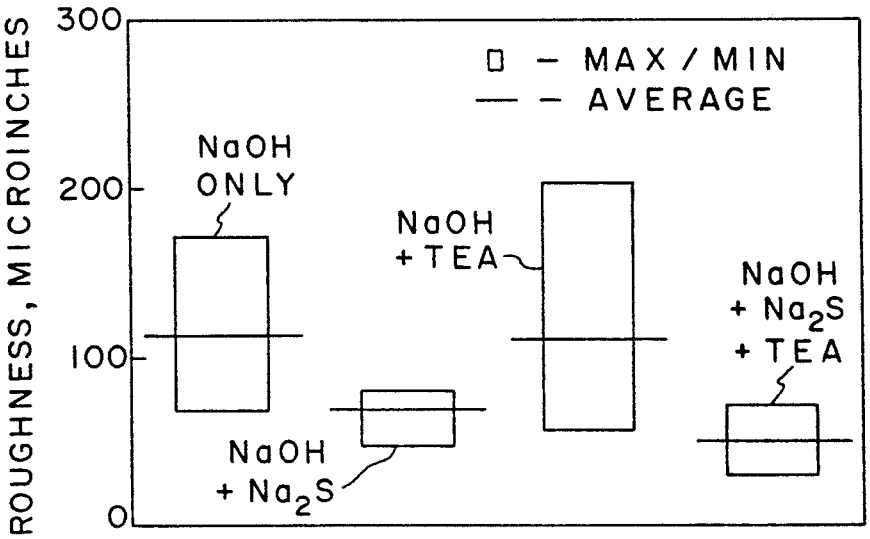
FIG. 2 shows the effect of $Na_2S$ and TEA additions to NaOH on AA7075.

Maximum, minimum and average roughness for each of the etching systems are shown for 2090-T3 in FIG. 1 and 7075-T6 in FIG. 2. The data shows the significant effect that $Na_2S$ additions have on both 2090-T3 and 7075-T6 compared to NaOH with no additives. Additions of TEA alone are not adequate and, in fact, increase the average roughness of 2090-T3. With the combination of NaOH, $Na_2S$ and TEA, roughness of as low as 46 microinches on 2090-T3 and 29 microinches on 7075-T6 was achieved (see Tables 2 and 3 and FIGS. 1 and 2).

Figure 3:
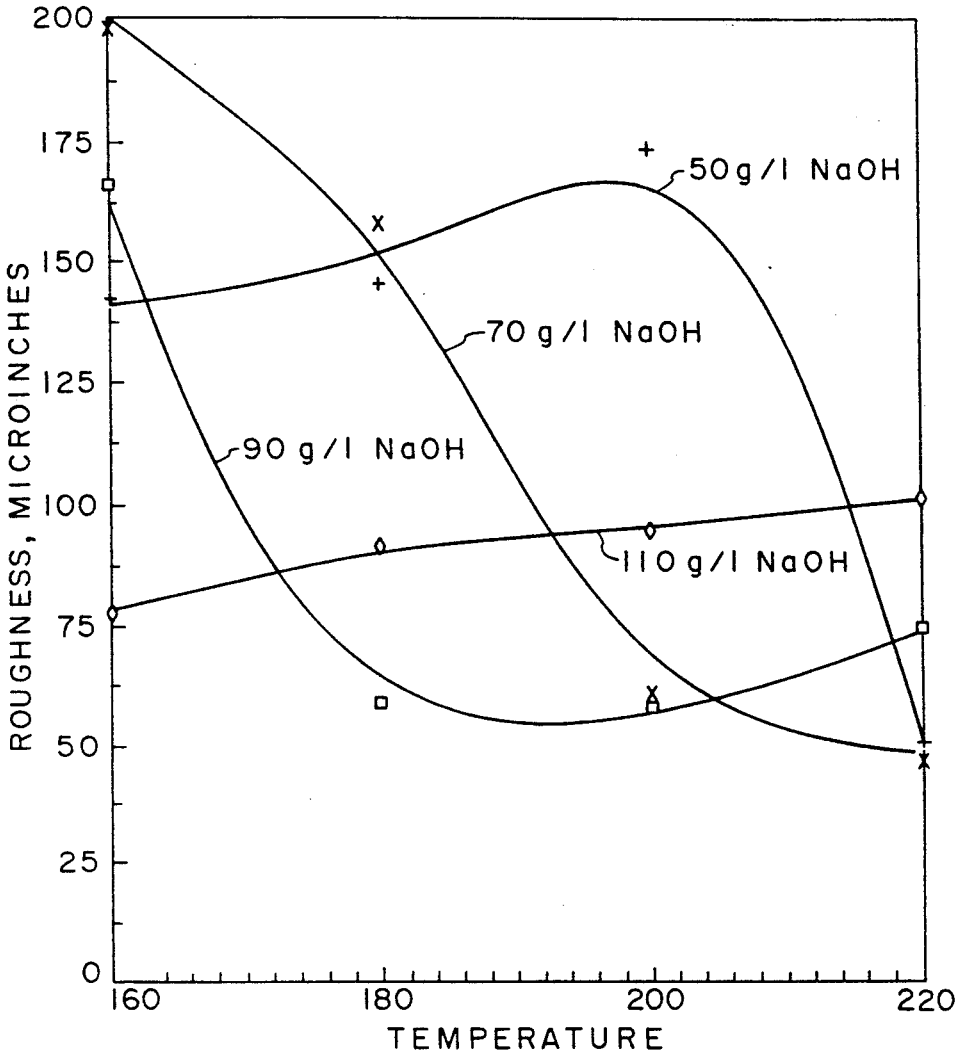
FIG. 3 shows the effect of variations in NaOH concentration and temperature on the roughness of 2090-T3 at 20 g/l Al, 75 g/l TEA and 42 g/l $Na_2S$.
Figure 4:
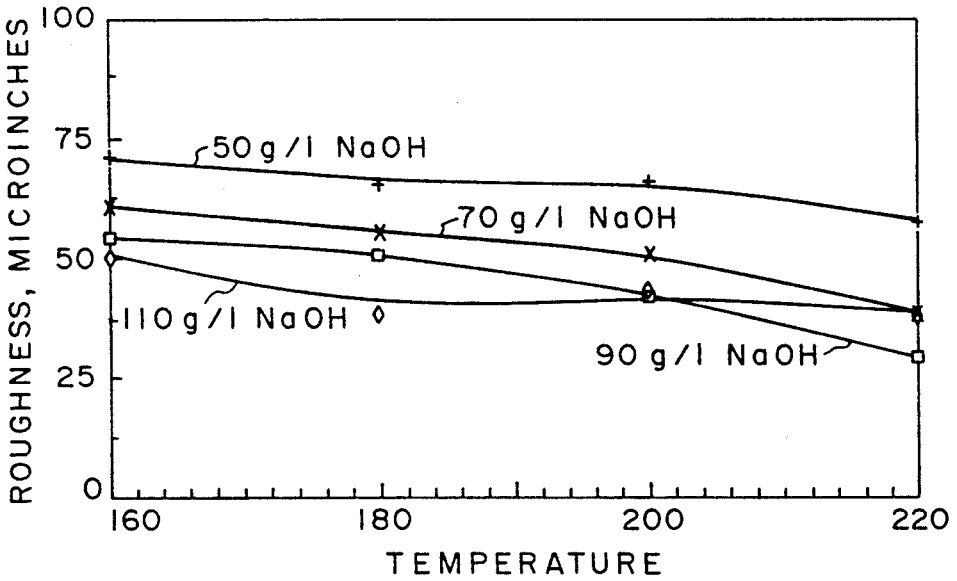
FIG. 4 shows the effect of variations in NaOH concentration and temperature on the roughness of 7075-T6 at 20 g/l Al, 75 g/l TEA and 42 g/l $Na_2S$.

The data for the three-component system at 20 q/L aluminum is plotted in FIGS. 3 and 4 for 2090-T3 and 7075-T6. Alloy 2090-T3 is sensitive to NaOH concentration and temperature. The best results are obtainable at the highest temperatures and lowest NaOH concentrations. For 7075-T6, the use of higher temperatures favours lower roughness as was the case with 2090-T3. But, unlike 2090-T3, higher NaOH concentrations produce best results although fairly good results were obtained at even the lowest NaOH concentration.

Referring again to Tables 2 and 3, at both 40 and 60 g/L aluminum, very good roughnesses and etch rates are obtainable at the high temperature by operating at an NaOH concentration of 50–90 g/L.

Figure 5:
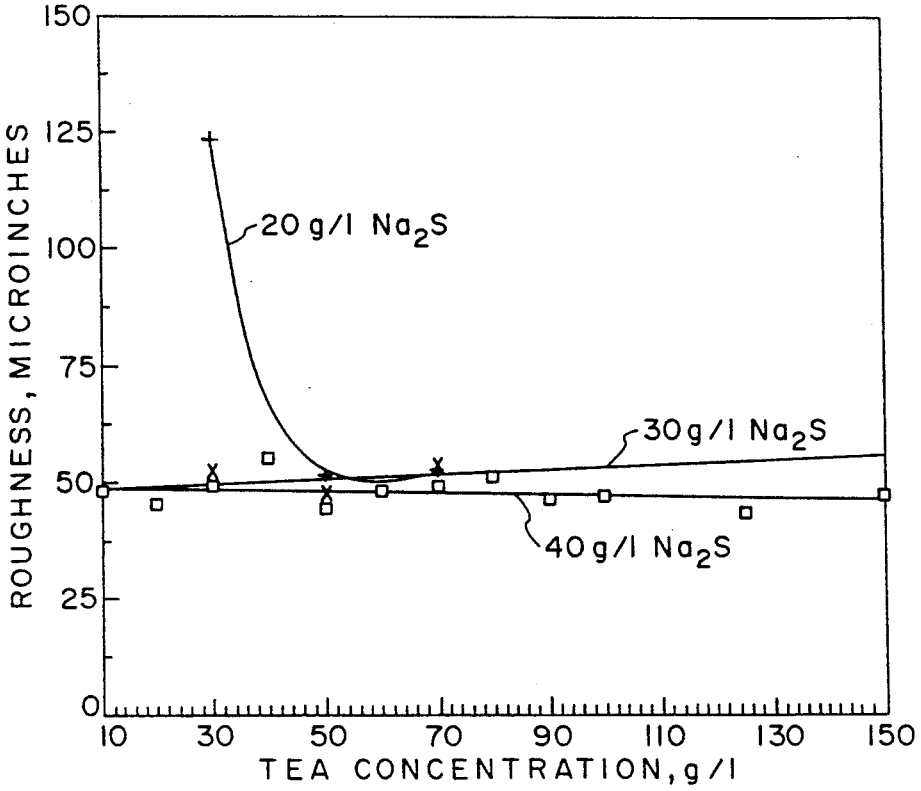
FIG. 5 shows the effect of Na2S and TEA concentrations on the roughness of 2090-T3 in chemical milling solution containing 70 g/l NaOH and 20 g/l Al at 220° F.
Figure 6:
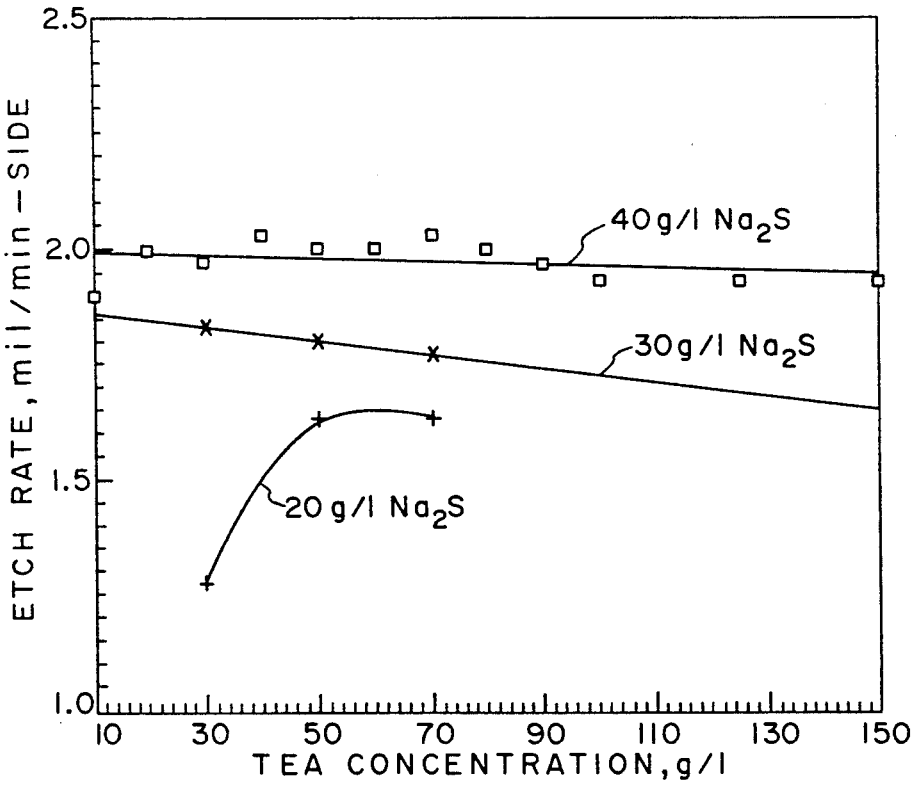
FIG. 6 shows the effect of $Na_2S$ and TEA concentrations on the etch rate of 2090-T3 in chemical milling solution containing 70 g/l NaOH and 20 g/l Al at 220° F.

Various amounts of $Na_2S$ and TEA were added to an 80 and 70 g/L NaOH solution with roughness and etch rate results shown in Tables 4 and 5 for each alloy. These data are plotted in FIGS. 5 and 6 for 2090-T3 alloy.

A level of 20 g/L $Na_2S$ appears useful, and 30 or 40 g/L $Na_2S$ produced satisfactory roughness and etch rates.

The effect of combinations of NaOH, $Na_2S$, TEA and aluminum concentration and temperature on both alloys 2090-T3 and 7075-T6 was tested. Tables 6 and 7 show the roughness and etch rate results. Different NaOH ranges for each of three aluminum contents, 20, 40 and 60 g/L, was evaluated.

Immediately apparent is the significant effect of NaOH level on 2090-T3. At 20 g/L aluminum, the 50 g/L NaOH level produced a very high roughness and low etch rates compared to 70 g/L NaOH. At 40 and 60 g/L aluminum, 60 g/L NaOH is preferred over 80 g/L and 70 over 90. 7075-T6 appears to favour the higher NaOH concentration at each aluminum level.

TABLE 1

MATERIAL IDENTIFICATION

| Material | Gauge (inches) | S# |
|---|---|---|
| 2090-T3 | .190 | 589193 |
| 2090-T31 | .190 | 589192 |
| 2090-T83 | .190 | 589181 |
| 2090-T84 | .079 | 589771 |
| 2091-T3 | .125 | 589183 |
| 2091-T8 | .125 | 589211 |
| 2024-T3 | .190 | 589169 |
| 7075-T6 | .190 | 589189 |

TABLE 2

EFFECT OF COMPOSITION, TEMPERATURE AND SODIUM HYDROXIDE CONCENTRATION ON SURFACE ROUGHNESS AND ETCH RATE OF 2090-T3 ALLOY

| | | | | Roughness (microinches)/ Etch Rate (mils/min-side) | | | |
|---|---|---|---|---|---|---|---|
| Al* | NaOH | TEA | $Na_2S$ | 160° F. | 180° F. | 200° F. | 220° F. |
| 20 | 50 | 0 | 0 | 131/0.70 | 140/0.30 | 446/0.33 | 381/0.37 |
| 20 | 70 | 0 | 0 | 206/0.40 | 140/0.57 | 144/1.53 | 135/1.83 |
| 20 | 90 | 0 | 0 | 141/0.43 | 110/0.73 | 157/1.80 | 149/2.03 |
| 20 | 110 | 0 | 0 | 202/0.40 | 130/0.07 | 176/1.90 | 178/2.13 |
| 20 | 50 | 0 | 42 | 71/0.43 | 92/1.33 | 126/2.07 | 100/2.10 |
| 20 | 70 | 0 | 42 | 70/0.90 | 101/1.50 | 136/2.40 | 131/2.50 |
| 20 | 90 | 0 | 42 | 90/1.00 | 112/1.80 | 177/2.80 | 150/2.93 |
| 20 | 110 | 0 | 42 | 110/1.13 | 122/2.17 | 169/3.13 | 145/3.20 |
| 20 | 50 | 75 | 0 | 118/0.27 | 211/0.33 | 366/0.18 | 374/1.13 |
| 20 | 70 | 75 | 0 | 200/0.30 | 294/0.20 | 357/0.20 | 268/0.33 |
| 20 | 90 | 75 | 0 | 200/0.33 | 314/0.27 | 304/0.30 | 215/0.70 |
| 20 | 110 | 75 | 0 | 248/0.33 | 308/0.37 | 225/0.73 | 113/1.60 |
| 20 | 50 | 75 | 42 | 142/0.17 | 145/0.50 | 173/0.63 | 46/1.67 |
| 20 | 70 | 75 | 42 | 198/0.23 | 158/0.57 | 60/1.33 | 50/2.03 |
| 20 | 90 | 75 | 42 | 166/0.47 | 58/1.23 | 57/1.77 | 74/2.13 |
| 20 | 110 | 75 | 42 | 77/1.00 | 91/1.40 | 94/1.80 | 101/2.23 |
| 40 | 50 | 75 | 42 | — | — | — | 43/1.70 |
| 40 | 70 | 75 | 42 | — | — | — | 45/1.93 |
| 40 | 90 | 75 | 42 | — | — | — | 64/2.00 |
| 40 | 110 | 75 | 42 | — | — | — | 75/1.97 |

TABLE 2-continued

EFFECT OF COMPOSITION, TEMPERATURE AND SODIUM HYDROXIDE CONCENTRATION ON SURFACE ROUGHNESS AND ETCH RATE OF 2090-T3 ALLOY

| | | | | Roughness (microinches)/ Etch Rate (mils/min-side) | | | |
|---|---|---|---|---|---|---|---|
| Al* | NaOH | TEA | $Na_2S$ | 160° F. | 180° F. | 200° F. | 220° F. |
| 60 | 70 | 75 | 42 | — | — | — | 50/1.77 |
| 60 | 90 | 75 | 42 | — | — | — | 48/1.77 |
| 60 | 110 | 75 | 42 | — | — | — | 76/1.63 |
| 60 | 130 | 75 | 42 | — | — | — | 100/1.47 |

*All concentrations are in grams/liter
Etch times are 15 minutes

TABLE 3

EFFECT OF COMPOSITION, TEMPERATURE AND SODIUM HYDROXIDE CONCENTRATION ON SURFACE ROUGHNESS AND ETCH RATE OF 7075-T6 ALLOY

| | | | | Roughness (microinches)/ Etch Rate (mils/min-side) | | | |
|---|---|---|---|---|---|---|---|
| Al* | NaOH | TEA | $Na_2S$ | 160° F. | 180° F. | 200° F. | 220° F. |
| 20 | 50 | 0 | 0 | 99/0.03 | 126/0.07 | 162/0.17 | 164/0.43 |
| 20 | 70 | 0 | 0 | 133/0.07 | 160/0/13 | 130/0.61 | 91/0.97 |
| 20 | 90 | 0 | 0 | 146/0.10 | 172/0.23 | 76/1.07 | 75/1.40 |
| 20 | 110 | 0 | 0 | 71/0.30 | 70/0.70 | 68/1.17 | 73/1.57 |
| 20 | 50 | 0 | 42 | 79/0.23 | 76/0.50 | 80/0.93 | 81/1.20 |
| 20 | 70 | 0 | 42 | 57/0.37 | 71/0.60 | 69/1.03 | 74/1.37 |
| 20 | 90 | 0 | 42 | 55/0.40 | 58/0.67 | 67/1.17 | 75/1.57 |
| 20 | 110 | 0 | 42 | 47/0.43 | 59/0.77 | 68/1.27 | 72/1.77 |
| 20 | 50 | 75 | 0 | 94/0.07 | 98/0.10 | 94/0.17 | 105/0.20 |
| 20 | 70 | 75 | 0 | 99/0.03 | 123/0.10 | 164/0.17 | 204/0.27 |
| 20 | 90 | 75 | 0 | 159/0.10 | 150/0.17 | 94/0.57 | 86/0.80 |
| 20 | 110 | 75 | 0 | 93/0.27 | 71/0.67 | 63/0.97 | 56/1.37 |
| 20 | 50 | 75 | 42 | 71/0.27 | 65/0.50 | 66/0.77 | 57/0.97 |
| 20 | 70 | 75 | 42 | 61/0.40 | 55/0.70 | 51/0.97 | 38/1.30 |
| 20 | 90 | 75 | 42 | 54/0.50 | 34/0.77 | 42/1.10 | 29/1.53 |
| 20 | 110 | 75 | 42 | 52/0.53 | 47/0.87 | 43/1.30 | 38/1.80 |
| 40 | 50 | 75 | 42 | — | — | — | 42/1.20 |
| 40 | 70 | 75 | 42 | — | — | — | 42/1.43 |
| 40 | 90 | 75 | 42 | — | — | — | 42/1.57 |
| 40 | 110 | 75 | 42 | — | — | — | 38/1.77 |
| 60 | 70 | 75 | 42 | — | — | — | 37/1.40 |
| 60 | 90 | 75 | 42 | — | — | — | 30/1.53 |
| 60 | 110 | 75 | 42 | — | — | — | 35/1.63 |
| 60 | 130 | 75 | 42 | — | — | — | 37/1.77 |

*All concentrations are in grams/liter
Etch times are 15 minutes

TABLE 4

EFFECT OF TEA AND SODIUM SULPHIDE CONCENTRATION ON SURFACE ROUGHNESS AND ETCH RATE OF 2090-T3 ALLOY

| | | | | Roughness (microinches)/ Etch Rate (mils/min-side) | | | |
|---|---|---|---|---|---|---|---|
| Al* | NaOH | TEA | $Na_2S$ | 160° F. | 180° F. | 200° F. | 220° F. |
| 20 | 80 | 37.5 | 42 | 198/0.27 | 193/0.50 | 197/0.87 | 52/1.83 |
| 20 | 80 | 56.2 | 42 | 163/0.23 | 155/0.57 | 175/0.73 | 46/1.86 |
| 20 | 70 | 30 | 20 | — | — | — | 123/1.27 |
| 20 | 70 | 50 | 20 | — | — | — | 51/1.63 |
| 20 | 70 | 70 | 20 | — | — | — | 52/1.63 |
| 20 | 70 | 30 | 30 | — | — | — | 51/1.83 |
| 20 | 70 | 50 | 30 | — | — | — | 47/1.80 |
| 20 | 70 | 70 | 30 | — | — | — | 53/1.72 |
| 20 | 70 | 10 | 40 | — | — | — | 48/1.90 |
| 20 | 70 | 20 | 40 | — | — | — | 45/2.00 |
| 20 | 70 | 30 | 40 | — | — | — | 49/1.97 |
| 20 | 70 | 40 | 40 | — | — | — | 55/2.03 |
| 20 | 70 | 50 | 40 | — | — | — | 44/2.00 |
| 20 | 70 | 60 | 40 | — | — | — | 48/2.00 |
| 20 | 70 | 70 | 40 | — | — | — | 49/2.03 |
| 20 | 70 | 80 | 40 | — | — | — | 51/2.00 |
| 20 | 70 | 90 | 40 | — | — | — | 46/1.97 |
| 20 | 70 | 100 | 40 | — | — | — | 47/1.93 |
| 20 | 70 | 125 | 40 | — | — | — | 43/1.93 |

TABLE 4-continued

EFFECT OF TEA AND SODIUM SULPHIDE CONCENTRATION ON SURFACE ROUGHNESS AND ETCH RATE OF 2090-T3 ALLOY

| | | | | Roughness (microinches)/ Etch Rate (mils/min-side) | | | |
|---|---|---|---|---|---|---|---|
| Al* | NaOH | TEA | $Na_2S$ | 160° F. | 180° F. | 200° F. | 220° F. |
| 20 | 70 | 150 | 40 | — | — | — | 47/1.93 |

*All concentrations are in grams/liter
Etch times are 15 minutes

TABLE 5

EFFECT OF TEA AND SODIUM SULPHIDE CONCENTRATION ON SURFACE ROUGHNESS AND ETCH RATE OF 7075-T6 ALLOY

| | | | | Roughness (microinches)/ Etch Rate (mils/min-side) | | | |
|---|---|---|---|---|---|---|---|
| Al* | NaOH | TEA | $Na_2S$ | 160° F. | 180° F. | 200° F. | 220° F. |
| 20 | 80 | 37.5 | 42 | 64/0.33 | 63/0.63 | 65/0.93 | 52/1.17 |
| 20 | 80 | 56.2 | 42 | 71/0.33 | 66/0.60 | 57/0.87 | 50/1.20 |
| 20 | 70 | 30 | 20 | — | — | — | 65/1.03 |
| 20 | 70 | 50 | 20 | — | — | — | 51/1.03 |
| 20 | 70 | 70 | 20 | — | — | — | 56/1.03 |
| 20 | 70 | 30 | 30 | — | — | — | 55/1.20 |
| 20 | 70 | 50 | 30 | — | — | — | 51/1.20 |
| 20 | 70 | 70 | 30 | — | — | — | 51/1.13 |
| 20 | 70 | 10 | 40 | — | — | — | 42/1.27 |
| 20 | 70 | 20 | 40 | — | — | — | 49/1.23 |
| 20 | 70 | 30 | 40 | — | — | — | 45/1.27 |
| 20 | 70 | 40 | 40 | — | — | — | 33/1.27 |
| 20 | 70 | 50 | 40 | — | — | — | 41/1.30 |
| 20 | 70 | 60 | 40 | — | — | — | 42/1.27 |
| 20 | 70 | 70 | 40 | — | — | — | 39/1.33 |
| 20 | 70 | 80 | 40 | — | — | — | 41/1.37 |
| 20 | 70 | 90 | 40 | — | — | — | 37/1.40 |
| 20 | 70 | 100 | 40 | — | — | — | 36/1.40 |
| 20 | 70 | 125 | 40 | — | — | — | 34/1.40 |
| 20 | 70 | 150 | 40 | — | — | — | 32/1.57 |

*All concentrations are in grams/liter
Etch times are 15 minutes

TABLE 6

COMBINATION EFFECT OF CHEMICAL MILLING ON ALLOY 2090-T3

| | | | Roughness (microinches)/ Etch Rate (mils/min-side) | | | | | |
|---|---|---|---|---|---|---|---|---|
| | | | NaOH (20 Al) | | NaOH (40 Al) | | NaOH (60 Al) | |
| $Na_2S$[1] | TEA | Temp[2,3] | | | | | | |
| 35 | 25 | 215 | 50 | 138/0.89 | 60 | 46/1.81 | 70 | 50/1.86 |
| 35 | 25 | 215 | 70 | 48/1.85 | 80 | 56/2.03 | 90 | 88/1.93 |
| 45 | 25 | 215 | 50 | 143/0.81 | 60 | 46/1.85 | 70 | 58/1.89 |
| 45 | 25 | 215 | 70 | 52/1.89 | 80 | 60/2.04 | 90 | 91/1.91 |
| 35 | 35 | 215 | 50 | 146/1.46 | 60 | 43/1.80 | 70 | 55/1.82 |
| 35 | 35 | 215 | 70 | 45/1.83 | 80 | 56/2.04 | 90 | 82/1.84 |
| 45 | 35 | 215 | 50 | 172/0.78 | 60 | 41/1.80 | 70 | 48/1.83 |
| 45 | 35 | 215 | 70 | 47/1.86 | 80 | 55/2.01 | 90 | 74/1.86 |
| 35 | 25 | 225 | 50 | 132/0.87 | 60 | 46/1.91 | 70 | 49/1.96 |
| 35 | 25 | 225 | 70 | 53/2.02 | 80 | 64/2.14 | 90 | 66/2.00 |
| 45 | 25 | 225 | 50 | 146/1.25 | 60 | 51/1.98 | 70 | 56/1.98 |
| 45 | 25 | 225 | 70 | 55/2.07 | 80 | 53/2.22 | 90 | 72/1.95 |
| 35 | 35 | 225 | 50 | 145/1.30 | 60 | 44/1.99 | 70 | 45/1.91 |
| 35 | 35 | 225 | 70 | 46/1.98 | 80 | 57/2.16 | 90 | 57/1.97 |
| 45 | 35 | 225 | 50 | 145/0.76 | 60 | 43/1.92 | 70 | 49/1.94 |
| 45 | 35 | 225 | 70 | 44/1.99 | 80 | 58/2.09 | 90 | 73/1.91 |
| 40 | 30 | 220 | 60 | 47/1.93 | 70 | 54/2.04 | 80 | 66/1.95 |
| 40 | 30 | 220 | 60 | 46/1.89 | 70 | 43/2.07 | 80 | 62/1.95 |
| 40 | 30 | 220 | 60 | 47/1.84 | 70 | 58/2.07 | 80 | 62/1.95 |

[1]All concentrations are grams/liter
[2]Temperature in °F.
[3]Time = 15 minutes

TABLE 7

COMBINATION EFFECT OF CHEMICAL MILLING ON ALLOY 7075-T6

| | | | Roughness (microinches)/ Etch Rate (mils/min-side) | | | | | |
|---|---|---|---|---|---|---|---|---|
| | | | NaOH (20 Al) | | NaOH (40 Al) | | NaOH (60 Al) | |
| $Na_2S$[1] | TEA | Temp[2,3] | | | | | | |
| 35 | 25 | 215 | 50 | 66/0.84 | 60 | 56/1.16 | 70 | 49/1.32 |
| 35 | 25 | 215 | 70 | 53/1.13 | 80 | 49/1.37 | 90 | 39/1.53 |
| 45 | 25 | 215 | 50 | 67/1.02 | 60 | 52/1.19 | 70 | 44/1.36 |
| 45 | 25 | 215 | 70 | 51/1.17 | 80 | 47/1.41 | 90 | 47/1.53 |
| 35 | 35 | 215 | 50 | 60/0.89 | 60 | 53/1.17 | 70 | 55/1.82 |
| 35 | 35 | 215 | 70 | 49/1.15 | 80 | 44/1.34 | 90 | 51/1.84 |
| 45 | 35 | 215 | 50 | 64/0.89 | 60 | 50/1.21 | 70 | 42/1.33 |
| 45 | 35 | 215 | 70 | 48/1.16 | 80 | 42/1.40 | 90 | 44/1.47 |
| 35 | 25 | 225 | 50 | 54/0.88 | 60 | 53/1.31 | 70 | 48/1.48 |
| 35 | 25 | 225 | 70 | 52/1.29 | 80 | 50/1.52 | 90 | 44/1.67 |
| 45 | 25 | 225 | 50 | 55/1.11 | 60 | 48/1.38 | 70 | 46/1.52 |
| 45 | 25 | 225 | 70 | 47/1.26 | 80 | 43/1.60 | 90 | 40/1.71 |
| 35 | 35 | 225 | 50 | 61/0.90 | 60 | 49/1.32 | 70 | 45/1.91 |
| 35 | 35 | 225 | 70 | 54/1.29 | 80 | 42/1.51 | 90 | 57/1.97 |
| 45 | 35 | 225 | 50 | 59/0.99 | 60 | 47/1.34 | 70 | 43/1.48 |
| 45 | 35 | 225 | 70 | 52/1.28 | 80 | 39/1.53 | 90 | 37/1.62 |
| 40 | 30 | 220 | 60 | 54/1.20 | 70 | 46/1.37 | 80 | 40/1.56 |
| 40 | 30 | 220 | 60 | 54/1.18 | 70 | 44/1.40 | 80 | 43/1.54 |
| 40 | 30 | 220 | 60 | 56/1.15 | 70 | 50/1.35 | 80 | 40/1.54 |

[1]All concentrations are grams/liter
[2]Temperature in °F.
[3]Time = 15 minutes

Having thus described the invention, what is claimed is:

1. A method of etching an aluminum base alloy product, wherein the product has a roughness height rating of less than 125 microinches, the method comprising the steps of:

(a) providing an etch bath based on a liter of bath comprised of:
(i) 30–110 gms/liter sodium hydroxide;
(ii) 15–150 gms/liter aluminum;
(iii) at least 20 gms/liter sodium sulphide; and
(iv) at least 20 gms/liter alkanolamine, the remainder water;
(b) maintaining said bath at a temperature range of 215° to 225° F.;
(c) etching said product in said bath; and
(d) rinsing said product after etching to provide a product having a high level of smoothness.

2. The method in accordance with claim 1 wherein the sodium hydroxide is in the range of 40 to 90 grams/-liter.

3. The method in accordance with claim 1 wherein the sodium sulphide is in the range of 20 to 60 grams/-liter.

4. The method in accordance with claim 1 wherein the alkanolamine comprises triethanolamine an is in the range of 20 to 60 grams/liter.

5. The method in accordance with claim 1 wherein the aluminum is in the range of 20 to 130 grams/liter.

6. The method in accordance with claim 4 wherein the sodium sulphide plus triethanolamine are present in the bath equal to the amount of sodium hydroxide.

7. The method in accordance with claim 1 wherein aluminum is present in the amount of at least 20 grams/-liter.

8. A method of etching a lithium-containing aluminum base alloy product, the method comprising the steps of:

(a) providing an etch bath based on a liter of bath comprised of:
(i) 40–90 gms/liter sodium hydroxide;
(ii) 20–130 gms/liter aluminum;
(iii) 20 to 60 gms/liter sodium sulphide; and
(iv) 20 to 60 gms/liter triethanolamine, the remainder water;
(b) maintaining said bath at a temperature range of 250° to 225° F.;
(c) etching said product in said bath; and
(d) rinsing said product after etching to provide a product having a roughness height rating of less than 100 microinches.

9. A method of etching a lithium-containing aluminum base alloy product, the method comprising the steps of:

(a) providing an etch bath comprised of:
(i) 50–90 gms/liter sodium hydroxide;
(ii) 20–130 gms/liter aluminum;
(iii) a least 20 gms/liter sodium sulphide; and
(iv) at least 20 gms/liter triethanolamine, the remainder water;
(b) maintaining said bath at a temperature range of 215° to 225° F.;
(c) etching said product in said bath; and
(d) rinsing said product after etching to provide a product having a roughness height rating of less than 100 microinches.

10. In a method of chemical milling aluminum alloys wherein a bath is provided suitable for chemically milling lithium-containing aluminum base alloy product wherein the lithium-containing aluminum alloy product has smooth finish after milling, the improvement comprising:

(a) providing a bath comprised of:
(i) 30–110 gms/liter sodium hydroxide;
(ii) 15–150 gms/liter aluminum;
(iii) at least 20 gms/liter sodium sulphide; and
(iv) at least 20 gms/liter alkanolamine, the remainder water; and
(b) maintaining said bath at a temperature range of 215° to 225° F. during milling, the etched surface having a roughness height rating of less than 100 microinches.

11. The method in accordance with claim 9 wherein the sodium hydroxide is in the range of 40 to 90 grams/-liter.

12. The method in accordance with claim 9 wherein the sodium sulphide is in the range of 20 to 60 grams/-liter.

13. The method in accordance with claim 9 wherein the alkanolamine comprises triethanolamine and is in the range of 20 to 60 grams/liter.

14. The method in accordance with claim 9 wherein the aluminum is in the range of 20 to 130 grams/liter.

15. The method in accordance with claim 12 wherein the sodium sulphide plus triethanolamine are present in the bath equal to the amount of sodium hydroxide.

16. The method in accordance with claim 9 wherein aluminum is present in the amount of at least 20 grams/-liter.

17. The method in accordance with claim 9 wherein the temperature is 220° F.

18. In a method of chemical milling aluminum alloys wherein a bath is provided suitable for chemically milling a lithium-containing aluminum base alloy product wherein the lithium-containing aluminum alloy product has a smooth finish after milling, the improvement comprising:

(a) providing a bath consisting essentially of:
(i) 50–90 gms/liter sodium hydroxide;
(ii) 20–130 gms/liter aluminum;
(iii) at least 20 gms/liter sodium sulphide; and
(iv) at least 20 gms/liter triethanolamine, the remainder water; and
(b) maintaining said bath at a temperature range of 215° to 225° F. during milling, the etched surface having a roughness height rating of less than 100 microinches.

19. The method of claim 1 wherein said aluminum base alloy product comprises a lithium-containing aluminum alloy.

* * * * *